United States Patent [19]

Shimo et al.

[11] 4,005,161

[45] Jan. 25, 1977

[54] VARIABLE STAGE TYPE CARBURETOR

[75] Inventors: Shoji Shimo; Yukio Hosho, both of Katsuta; Hideo Usui, Hitachi; Satosi Suzuki, Katsuta, all of Japan

[73] Assignee: Hitachi, Ltd., Japan

[22] Filed: Feb. 18, 1975

[21] Appl. No.: 550,279

[30] Foreign Application Priority Data

Feb. 22, 1974 Japan ..... 49-20562

[52] U.S. Cl. ..... 261/44 R; 261/52

[51] Int. Cl.[2] ..... F02M 9/14

[58] Field of Search ..... 261/52, 44 R

[56] References Cited

UNITED STATES PATENTS

| | | | |
|---|---|---|---|
| 2,195,867 | 4/1940 | Mallory | 261/52 |
| 2,198,676 | 4/1940 | Mallory | 261/52 |
| 2,710,604 | 6/1955 | Snyder | 261/50 A |
| 2,747,848 | 5/1956 | Kehoe | 261/52 |
| 3,006,618 | 10/1961 | Carlson et al. | 261/52 |
| 3,151,189 | 9/1964 | McSeveny | 261/52 |
| 3,167,254 | 1/1965 | Goodyear | 261/39 C |
| 3,284,061 | 11/1966 | Gordon | 261/39 C |
| 3,880,962 | 4/1975 | Rhodes et al. | 261/52 |
| 3,896,195 | 7/1975 | Harrison | 261/52 |
| 3,937,768 | 2/1976 | Bier et al. | 261/52 |

*Primary Examiner*—Tim R. Miles
*Attorney, Agent, or Firm*—Craig & Antonelli

[57] ABSTRACT

A variable stage type carburetor provided with a venturi vane which is adapted to vary the venturi area in a venturi portion thereof, commensurate to the opening of a throttle valve. This carburetor features that, in the running condition where the opening of a throttle valve is considerably large and yet the quantity of intake air is relatively less, the venturi vane is forcedly displaced in a direction to be closed so as to increase the venturi negative pressure in the venturi portion, thereby enhancing the injection of fuel.

14 Claims, 3 Drawing Figures

VARIABLE STAGE TYPE CARBURETOR

This invention relates to a variable stage type carburetor which varies the cross sectional area in the venturi portion thereof commensurate to the opening of a throttle valve, and more particularly to a variable stage type carburetor which is provided with an opening control mechanism for use with a venturi vane constituting the venturi portion.

A variable stage type carburetor, in general, is used such as for a rotary piston engine. This type of carburetor comprises a throttle valve placed within an intake passage, venturi portion composed of a venturi vane located in the upstream of the throttle valve and adapted to be displaced commensurate to the opening of the throttle valve, and a metering needle attached to the venturi vane and adapted to meter fuel in cooperation with a nozzle mounted on the body proper of the carburetor.

A motor vehicle mounting thereon an internal combustion engine equipped with such a type carburetor is confronted by shortcomings such as so-called knocking or hesitation (the failure to obtain a smooth running condition of an engine due to lack of power), when a motor vehicle ascends a slope and the failure to achieve desired acceleration when rapid acceleration is wanted, with the throttle valve being fully opened, while maintaining the throttle valve in a somewhat open position.

Such shortcomings have been experienced with a running condition of an engine where the opening of the throttle valve is considerably large and yet the quantity of intake air is less, and are considered to be caused by a resulting lean mixture charge. In other words, since the quantity of the intake air is relatively less, despite considerably large openings of a throttle valve and a venturi vane, there results a decreased negative pressure prevailing in a venturi portion, so that the fuel fails to be fed to the engine in a desired amount.

It is accordingly a principal object of the invention to provide a variable stage type carburetor which eliminates lack of power in a running condition of an engine where the opening of a throttle valve is considerably large and yet the quantity of intake air is relatively less, thereby affording desired running condition for an engine.

According to the present invention, there is provided a variable stage type carburetor featuring that, in the running condition of an engine where the opening of a throttle valve is considerably large and the quantity of intake air is relatively less, a venturi vane is forcedly displaced in a direction to be closed, independently of the opening of a throttle valve, in an attempt to increase the venturi negative pressure with the resulting enhanced injection of fuel.

These and other objects and features of the present invention will be apparent from a reading of the ensuring point of the specification in conjunction with the accompanying drawings which indicate the embodiments of the invention.

Figure 1:
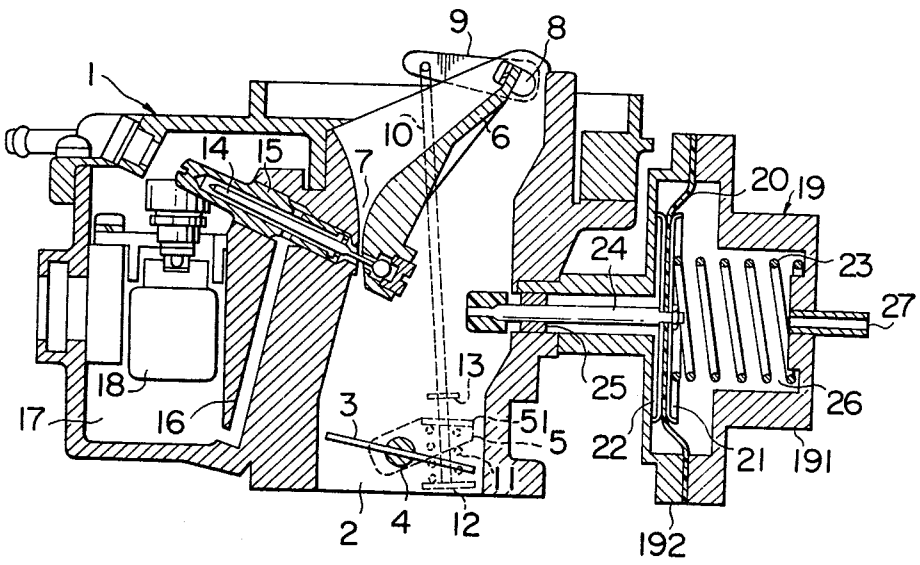
FIG. 1 is a longitudinal cross sectional view of a variable stage type carburetor as one embodiment of the invention.

Referring now to FIG. 1 which shows a variable stage type carburetor embodying the present invention, shown at 1 is a body proper of the carburetor and at 2 an intake passage defined in the body proper 1 of the carburetor. Provided within the intake passage 2 is a throttle valve 3 which is secured to a throttle valve shaft 4 by means of screws of the like. The throttle valve shaft 4 is rotatably supported in the body proper 1 of the carburetor and adapted to be rotated by means of an accelerator pedal or the like. A throttle valve lever 5 is secured on the throttle valve shaft 4 at the end of the latter. Provided in the upstream of the throttle valve 3 is a venturi vane 6 which forms a venturi portion 7 with the intake passage 2. The venturi vane 6 is secured on a vane shaft 8 at its one end and adapted to be rotated about the vane shaft 8. A vane lever 9 is secured on the end of the vane shaft 8. The vane lever 9 is connected via a link 10 to the throttle valve lever 5 in an attempt to bring the throttle valve 3 in an interlocking relation to the venturi vane 6. The link 10 is pivoted at its top end to the vane lever 9, while the lower end of the link 10 is loosely inserted in a hole defined in a pawl portion 51 of the throttle valve lever 5. The link 10 is formed with stoppers 12, 13 thereon, with the pawl portion being located therebetween. Confined between the stopper 12 and the pawl portion 51 is a coil spring having suitable loading characteristics. The spring 11 loads the link 10 in a manner that the stopper 13 is urged against the pawl portion 51. This causes a relative distance between the throttle valve lever 5 and the vane lever 9 to be maintained to the minimum which is defined by the stopper 13, while the throttle valve 3 interlocks with the venturi vane 6, with the aforesaid minimum distance being maintained. The position of the stopper 13 is designed, commensurate to the desired opening of the venturi vane 6 relative to the opening of the throttle valve 3. However, if the venturi vane 6 is so designed as to overcome the urging force of the coil spring 11, then the springs 11 may be compressed so that the opening of the venturi vane 6 is decreased relative to the opening of the throttle valve 3. Coupled to the tip portion of the venturi vane 6 is a jet needle 14 which may move in and out through a fuel nozzle 15 to meter the amount of fuel being supplied to an engine. Shown at 16 is a fuel passage which communicates a float chamber 17 with the fuel nozzle 15. Shown at 18 is a float which is provided in the float chamber 17, and the float 18 serves to maintain the fuel level in the float chamber 17 constant. Generally shown at 19 is a vane opening control means which consists of: housings 191, 192; negative-pressure detecting and operating member such as diaphragm 20, diaphragm plates 21, 22, and diaphragm spring 23; control member such as a push rod 24 and the like. The diaphragm 20 is held in position between housings 191, 192, while the push rod 24 is secured to the diaphragm 20 through the medium of diaphragm plates 21, 22. The housing 192 is threadingly secured to the body proper 1 of the carburetor. Shown at 25 is a seal member which is supported on the outer periphery of the push rod 24 so as to seal the interior of the housing 192 against the intake passage 2. The tip of the push rod 24 projects into the interior of the intake passage 2 and is adapted to abut on the venturi vane 6. Shown at 26 is a negative pressure chamber defined by the housing 191 and diaphragm 20, with a diaphragm spring 23 being housed within the chamber 26, into which is introduced the negative pressure in the venturi portion 7 via a negative pressure passage 27. Accordingly, the extent of the push rod 24 projecting into the intake cylinder 2 varies with the negative pressure in the venturi portion 7, i.e., the negative pressure in the negative pressure chamber 26. The vane-opening control means 19 is so designed that the tip of the push rod 24 is maintained apart from the venturi vane 6 when under the normal running condition, while the tip of the push rod 24 abuts on the venturi vane 6 when the quantity of the intake air is less relative to the opening of the venturi vane 6 such as in the case of a vehicle ascending a slope or rapid acceleration.

Operation of the aforesaid device will now be described by way of the normal running mode. Under running condition, the throttle valve 8 is opened to a given extent due to an accelerating pedal being trodden thereon. At this time, the displacement of the throttle valve 3 is transmitted to the venturi vane 6, in turn, by way of throttle valve lever 5, spring 11, link 10 and vane lever 9, so that the venturi vane 6 is opened to an extent commensurate to the opening of the throttle valve 3, thereby increasing the venturi area. At this time, the jet needle 14 attached to the tip of the venturi vane 5 follows the movement of the venturi vane 6 to thereby move through the fuel nozzle 15, so metering fuel to an amount commensurate to the flow rate of air passing the venturi portion and supplying the fuel to an engine. It should be noted in this respect that the tip of the push rod 24 in the vane opening control means 19 is so designed as to be kept apart from the venturi portion 6, as has been described earlier. The extent of the push rod 24 projecting into the intake cylinder 2 varies with the level of the negative pressure prevailing in the venturi portion.

In this case, the extent of the push rod 24 projecting in the intake passage 2 is considerably large in the low speed mode, because of the low negative pressure in the venturi portion 7, while the opening of the venturi vane 6 is kept small. On the other hand, in the high speed mode, the opening of the venturi vane 6 follows the displacement of the throttle valve 3 and thus increases, while the negative pressure in the venturi portion 7 increases and the projecting extent of the push rod 24 is kept reduced. As a result, the tip of the push rod 24 may be so set as to be apart from the venturi vane 6.

Description will now be given of the running condition of a vehicle ascending a slope and the rapid acceleration thereof.

In the case of running condition of a vehicle ascending a slope or rapid acceleration, there results less quantity of intake air, despite large openings of the throttle valve 3 and venturi vane 6, so that the negative pressure in the venturi portion 7 is decreased, while the diaphragm 20 is displaced by means of a diaphragm spring 23 in a manner to increase the projecting extent of the push rod 24. In this respect, there results a considerably large opening of the venturi vane 6, so that the push rod 24 abuts on the venturi vane 6 to close the venturi vane 6. In this respect, the extent to which the venturi vane is closed is so designed as to depend on the level of the negative pressure in the venturi portion 7 as well as on the projecting extent of the push rod 24. In this manner, the venturi vane 6 is forcedly closed, so that the negative pressure in the venturi portion 7 is increased and thus the flow rate of fuel is increased with the aforesaid increase in the negative pressure, thereby preventing the resulting lean mixture charge, with the accompanying good running characteristics of an engine.

Figure 2:
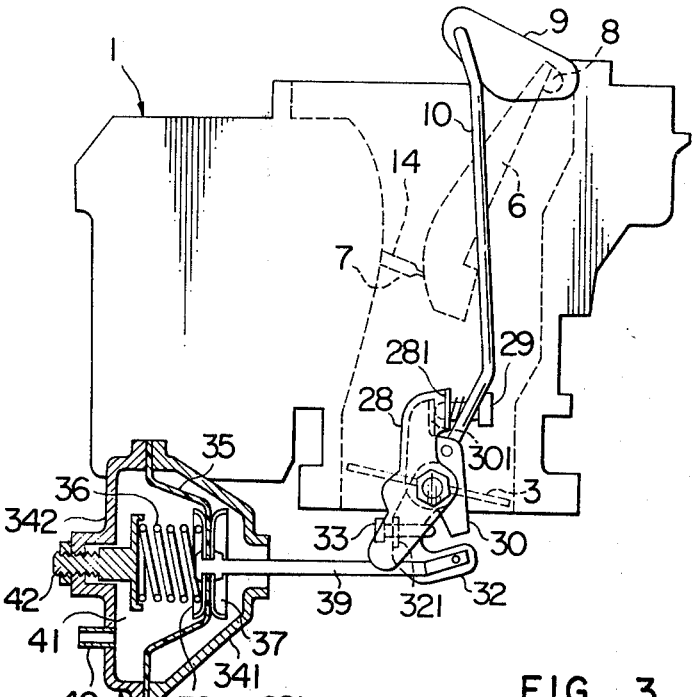
FIG. 2 is a front view, partly in cross section, of another embodiment of a variable stage type carburetor of the invention.
Figure 3:
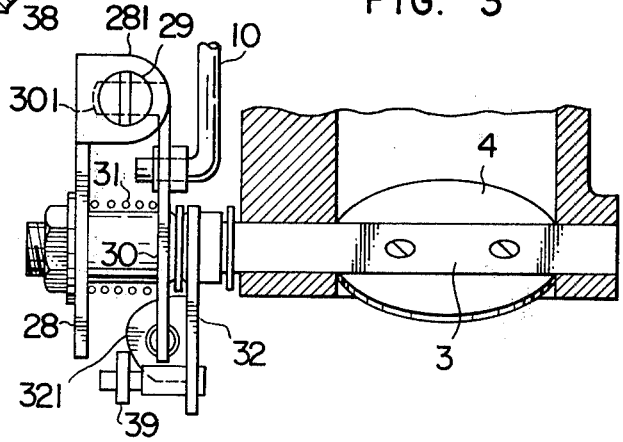
FIG. 3 is a front view, partly in cross section, of the variable stage type carburetor of FIG. 2.

Turning now to FIGS. 2 and 3 which show the second embodiment of the invention, like parts are designated like reference numerals throughout FIGS. 1, 2 and 3. Shown at 28 is a fixed throttle valve lever secured on the throttle valve shaft 4, while an adjusting screw 29 is threaded in a pawl portion 281 formed on the fixed throttle valve lever 28. Shown at 30 is a throttle valve lever which is rotatably mounted on the throttle valve shaft 4, while the pawl portion 301 formed on the rotatable throttle valve lever 30 is so designed as to abut on the adjusting screw 29 attached to the fixed throttle valve lever 28. In addition, the rotatable throttle valve lever 30 is engageable with the link 10 for interlocking relation to the venturi vane 6, while the rotatable throttle valve lever 30 is rotated by rotating the adjusting screw 29 for adjustment of the idle opening of the venturi vane 6. Shown at 31 is a torsion spring which is in engagement with the fixed throttle valve lever 28 and rotatable throttle valve lever 30 and acts to urge the rotatable lever 30 in the clockwise direction as viewed in FIG. 2, thereby urging the pawl portion 301 against the tip of the adjusting screw 29. As a result, the clockwise rotation of the fixed throttle valve lever 28 is transmitted through the medium of the torsion spring 31 to the rotatable throttle valve lever 30. Shown at 32 is a control member, i.e., a diaphragm lever which is rotatably mounted on the throttle valve shaft 4 and formed with a pawl portion in part thereof. Threaded in the pawl portion 321 is an adjusting screw 33 which is adapted to abut on the rotatable throttle valve lever 30, with some clearance being left therebetween. Thus, the adjustment of the aforesaid clearance by means of the adjusting screw 33 permits the adjustment of the minimum openings for the throttle valve 3 and venturi vane 6 which may be interlocked with each other mechanically. Designated 34 is a vane opening control means which consists of: housings 341, 342; a detecting and operating member, i.e., a diaphragm 35 adapted to detect a negative pressure and held in position by means of the housings 341, 342; and a diaphragm spring 36. A diaphragm rod 39 is secured to the diaphragm 35 by means of diaphragm plates 37, 38 and engages the control member, i.e., diaphragm lever 32 to thereby transmit the displacement of the diaphragm 35 to the diaphragm lever 32. Shown at 40 is a negative pressure passage which is in communication with the venturi portion 7, and thus it serves to introduce the venturi negative pressure into the negative pressure chamber defined by diaphragm 35 and housing 342. Shown at 42 is an adjusting-spring receiving member which adjusts the spring force of a diaphragm spring 36 provided in a negative pressure chamber 41.

With the aforesaid arrangement, when the throttle valve 3 remains at a small or low opening, the displacement of the throttle valve 3 is transmitted via fixed throttle valve lever 28, torsion spring 31, rotatable throttle valve lever 30 and link 10 to vane lever 9 and venturi vane 6, so that the venturi vane 6 is maintained at a small or low opening commensurate to that of the throttle valve 3. In this respect, since the negative pressure in the venturi portion 7 is low, the diaphragm 35 is biased to the right by means of the diaphragm spring 36, thereby maintaining the diaphragm lever 32 in a given position through the medium of the diaphragm rod 39. Then, when the throttle valve 3 is displaced so as to increase its opening, the displacement is transmitted to the venturi vane 6, as has been described earlier, via the fixed throttle valve lever 28, torsion spring 31, rotatable throttle valve lever 30, link 10 and vane lever 9, thereby increasing the opening of the venturi vane 6. In this case, the rotatable throttle valve lever 30 is displaced in the direction to abut on the adjusting screw 33 on the diaphragm lever 32. However, since there results a high venturi-negative pressure exerted on the diaphragm 35 in the vane-opening-control means 34, the diaphragm 35 is displaced in the direction to compress the diaphragm spring 36 against the diaphragm spring 36, so that the diaphragm lever 32 rotates in the clockwise direction, thus preventing interference with the free displacement of the rotatable throttle valve lever 30.

Description will be given of the cases where a vehicle ascends a slope. Since the quantity of intake air is less in this case, despite a large opening of the venturi vane 6, the venturi negative pressure is lowered and, the force acting on the diaphragm 35 fails to overcome the spring force of the diaphragm spring 36, so that the diaphragm 35 is biased by means of the diaphragm spring 36 to the right as viewed in the drawing. The displacement of the diaphragm is then transmitted via the diaphragm rod 39 to the diaphragm lever 32, so that the diaphragm lever 32 rotates in the counterclockwise direction. The rotation of the diaphragm lever 32 causes the adjusting screw 33 on the pawl portion 321 formed on the diaphragm lever 32 to abut on the rotatable throttle valve lever 30 to thereby rotate the throttle lever 30 in the counterclockwise direction, with the result that the venturi vane 6 is displaced in its closing direction by the medium of link 10 and vane lever 9. This increases the venturi negative pressure and enhances the injection of fuel. The extent of the venturi vane 6 to be closed depends on the venturi negative pressure resulting when the venturi vane is closed as well as on the rotating angle of the diaphragm lever 32.

As is apparent from the foregoing description, the venturi vane 6 is forcedly closed at the time of ascending a slope to increase the venturi negative pressure in an attempt to enhance the injection of fuel, so that there will not result a lean mixture charge but accompanying good running characteristics.

Meanwhile, with the second embodiment, there is used a diaphragm-spring receiving member which permits the adjustment of the spring force. However, this sort of receiving member may be used for the first embodiment. Furthermore, besides the first and second embodiments, the vane lever and the like may be likewise controlled so as to control the venturi vane for achieving the efficacies of the invention.

As is clear from the foregoing description, the present invention presents a carburetor which may prevent a lean mixture charge resulting in the running condition where the throttle valve opening is considerably large and yet the quantity of intake air is relatively less, and thereby it provides smooth output characteristics.

What is claimed is:

1. A variable stage type carburetor comprising an intake passage, venturi means including a movable venturi vane within said intake passage for defining a variable venturi portion with respect to said intake passage, throttle valve means including a throttle valve disposed in said intake passage downstream of said venturi vane, and mounted for rotation on a fixed throttle valve shaft for varying opening of said throttle valve within said intake passage, link means for interconnecting said venturi vane and said throttle valve to move said venturi vane commensurate with opening movement of said throttle valve to vary the venturi area of said venturi portion, and vane-opening control means for controlling movement of said venturi vane independently of said throttle valve, said control means forcedly displacing said venturi vane in a closing direction for increasing venturi negative pressure in said venturi portion when said throttle valve is considerably opened but the quantity of intake air is relatively small, wherein said control means comprise first means for detecting said negative pressure, and second means responsive to said first means for displacing said venturi vane in said closing direction when said detected negative pressure decreases, wherein said first means comprise a first housing attached to said carburetor;

a second housing sealingly affixed to said first housing;

a diaphragm being held in position between said first and second housings, said diaphragm and said second housing defining a negative pressure chamber into which said venturi negative pressure is introduced, said diaphragm being displaced in response to changes in said venturi negative pressure; and a diaphragm spring located in said negative pressure chamber; and wherein said second means comprise a diaphragm rod secured to said diaphragm;

a first lever engaging said diaphragm rod and rotatably mounted on said throttle valve shaft;

a second lever rotatably mounted on said throttle valve shaft and coupled by said link means to said venturi vane, said second lever acting in an interlocking relation to said first lever when said first lever is displaced; and a third lever interlocked with said second lever and secured on said throttle valve shaft.

2. A variable stage type carburetor as set forth in claim 1, wherein said third lever is provided with an adjusting means for adjusting the relative position between said second lever and said third lever.

3. A variable stage type carburetor as set forth in claim 1, wherein said first lever is provided with an adjusting means for adjusting the relative position between said first and second levers.

4. A variable stage type carburetor as set forth in claim 1, wherein said diaphragm spring located in said negative pressure chamber has one end seated on said diaphragm and the other end seated on a spring receiving member which is movable in the direction of said diaphragm to be displaced, to thereby vary the spring force of said diaphragm spring, while being confined between said diaphragm and said spring receiving member.

5. A variable stage carburetor comprising an intake passage, venturi means including a movable venturi vane within said intake passage defining a variable venturi portion with respect to said intake passage, throttle valve means including a throttle valve disposed in said intake passage downstream of said venturi vane, and mounted for rotation on a fixed throttle valve shaft for varying opening of said throttle valve within said intake passage, link means for interconnecting said venturi vane and said throttle valve to move said venturi vane commensurate with opening movement of said throttle valve to vary the venturi area of said venturi portion, fuel metering means cooperating with said venturi vane for introducing fuel into said intake passage, means for enabling said venturi vane to be moved in a closing direction independently of said throttle valve, and vane control means for controlling movement of said venturi vane in said closing direction in response to changes of venturi negative pressure in said venturi portion, said vane control means including first means for detecting variations in said negative pressure, and second means responsive to said first means for moving said venturi vane in said closing direction only upon decreases of said negative pressure such that when said throttle valve and said venturi vane are both in a substantially open position, said venturi vane alone may be moved to increase said venturi negative pressure.

6. A variable stage carburetor as set forth in claim 5, wherein said first means comprise a diaphragm supported between a first housing and a second housing to define chambers on opposite sides of said diaphragm, the chamber defined by said diaphragm and said first housing being connected to said venturi portion to introduce the venturi negative pressure into said chamber, and a spring means placed in said chamber between said diaphragm and said first housing to support said diaphragm against said negative pressure exerted on said diaphragm.

7. A variable stage carburetor as set forth in claim 6, wherein said second means comprise a rod connected at one end to said diaphragm, and a lever rotatably mounted on said throttle valve shaft in interlocking relation to the other end of said rod, said lever being further interlocked to said link means to move said venturi vane and being rotatable only in a direction to close said venturi vane by movement of said rod.

8. A variable stage carburetor comprising an intake passage, venturi means including a movable venturi vane within said intake passage for defining a variable venturi portion with respect to said intake passage, throttle valve means including a throttle valve disposed in said intake passage downstream of said venturi vane, and mounted for rotation on a fixed throttle valve shaft for varying opening of said throttle valve within said intake passage, link means for interconnecting said venturi vane and said throttle valve to move said venturi vane commensurate with opening movement of said throttle valve to vary the venturi area of said venturi portion, and vane-opening control means for controlling movement of said venturi vane independently of said throttle valve in response to changes of venturi negative pressure in said venturi portion, said control means forcedly displacing said venturi vane in a closing direction for increasing said venturi negative pressure when said throttle valve is in a substantially open position but the quantity of intake air is relatively small, wherein said control means comprise first means for detecting variations in said negative pressure, and second means responsive to said first means for displacing said venturi vane in said closing direction when said negative pressure decreases.

9. A variable stage type carburetor as set forth in claim 8, wherein said vane-opening control means consists of: a first housing having a hollow portion communicated with said intake passage and threaded in the body proper of said carburetor; a second housing sealingly affixed to said first housing to hold a diaphragm in position; a diaphragm spring placed in a negative pressure chamber which is defined by said diaphragm and said second housing and into which the venturi negative pressure is to be introduced; and a push rod which is secured to said diaphragm, moves through said hollow portion in said first housing and projects into said intake passage, said push rod being adapted to move in the direction to contact part of said venturi vane by means of said diaphragm spring, when the opening of said throttle valve is considerably large and yet the negative pressure exerted on said diaphragm is low, thereby forcedly displacing said venturi vane in the direction to be closed.

10. A variable stage type carburetor as set forth in claim 9, wherein said diaphragm spring located in said negative pressure chamber has one end seated on said diaphragm and the other end seated on a spring receiving member which is movable in the direction of said diaphragm to be displaced, to thereby vary the spring force of said diaphragm spring, while being confined between said diaphragm and said spring-receiving member.

11. A variable stage carburetor according to claim 8, wherein said first means comprises diaphragm means for detecting changes in said negative pressure, said diaphragm means including a diaphragm member movable in response to said changes in said negative pressure.

12. A variable stage carburetor according to claim 11, wherein said second means includes a control rod having a first end mounted on said diaphragm member and a second end extending into said intake passage adjacent said venturi vane, said second end of said control rod abutting against said venturi vane to displace said venturi vane into said closing direction only when said throttle valve and said venturi vane are substantially open and said negative pressure has decreased.

13. A variable stage carburetor according to claim 11, wherein said second means comprise a rod member mounted on said diaphragm member for movement therewith, and lever means interlocked with said rod member and said link means for displacing said venturi vane in said closing direction independently of said throttle valve when said throttle valve and said venturi vane are substantially open and said negative pressure has decreased.

14. A variable stage carburetor according to claim 13, wherein said lever means include lost-motion means interlocked with said fixed throttle valve shaft for transmitting movement of said rod member to said link means independently of said throttle valve.

* * * * *